United States Patent [19]

Belaire

[11] 4,026,114

[45] May 31, 1977

[54] REDUCING THE STARTING TORQUE OF DOUBLE-ACTING STIRLING ENGINES

[75] Inventor: Richard C. Belaire, Livonia, Mich.

[73] Assignee: Ford Motor Company, Dearborn, Mich.

[22] Filed: July 9, 1976

[21] Appl. No.: 703,882

[52] U.S. Cl. ..... 60/525; 60/656; 60/517

[51] Int. Cl.² ..... F02G 1/06

[58] Field of Search ..... 60/656, 517, 525, 526

[56] References Cited

UNITED STATES PATENTS

| | | | |
|---|---|---|---|
| 2,664,699 | 1/1954 | Kohler | 60/525 |
| 3,813,882 | 6/1974 | Hubschmann | 60/525 |

*Primary Examiner*—Allen M. Ostrager

*Attorney, Agent, or Firm*—Joseph W. Malleck; Keith L. Zerschling

[57] ABSTRACT

A closed working fluid system for a regenerative type Stirling engine is disclosed. The system has pistons therein arranged to be of the double-acting type. A compensating system is employed to eliminate the force differential that works upon the upper and lower surfaces of each double-acting piston during cold engine start and restarting conditions.

The compensating system employs a parallel path to the normal intercommunication between hot and cold chambers; a variable area valve is disposed in the parallel path. Communication through the variable area valve is controlled by a shuttle valve and one-way flow is assured by at least one check valve.

4 Claims, 2 Drawing Figures

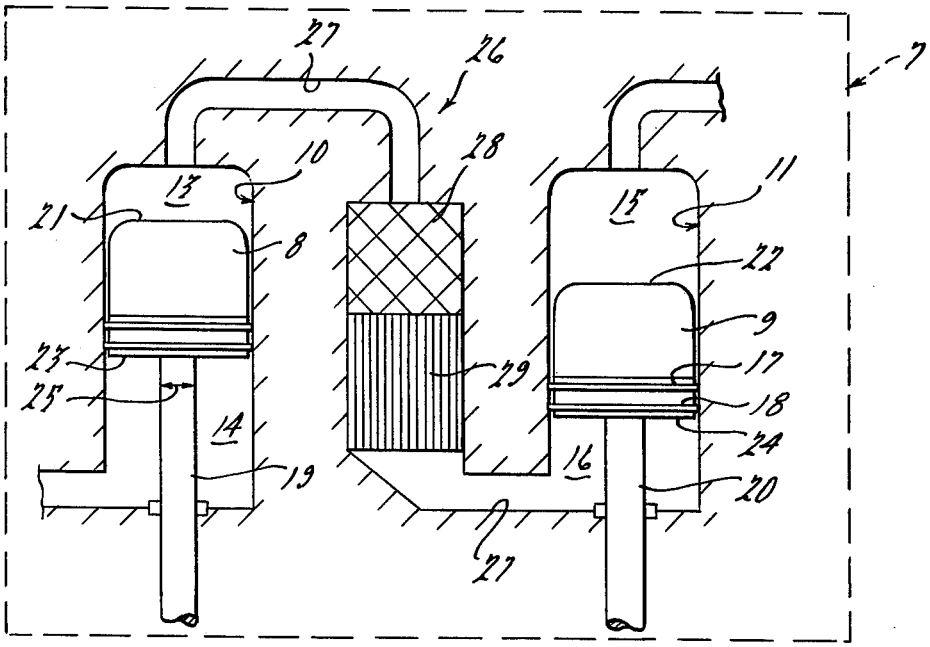
Prior Art FIG. 1.
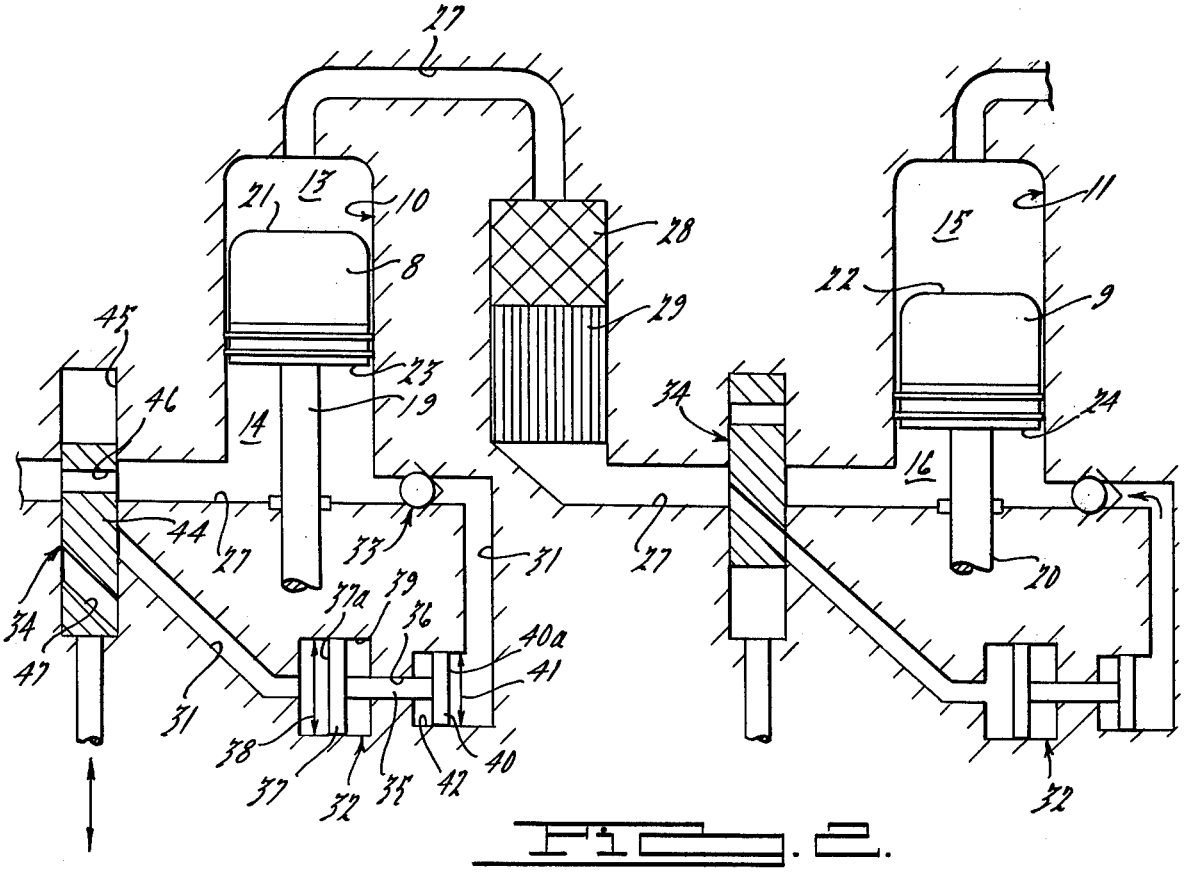
FIG. 2.

REDUCING THE STARTING TORQUE OF DOUBLE-ACTING STIRLING ENGINES

BACKGROUND OF THE INVENTION

A double-acting piston arrangement and/or double-acting displacement arrangement within a closed working system for a Stirling type engine has been found to be advantageous for use in a compact high-specific output engine; there is only one principal moving part per cycle. In a four cylinder Stirling-type engine equipped with double-acting pistons, each cylinder is divided by the piston to comprise a hot space and a cold space. The hot space of one cylinder is connected by a heater, regenerator and cooler assembly with the cold space of the next most adjacent cylinder. This type of arrangement delivers more work to the engine shaft than that which is used to provide compression of the working medium, provided the variations of the volume in the hot spaces are sufficiently advanced in phase with respect to the variations in the cold spaces. Most notably, in a double-acting piston arrangement, the piston transmits energy from the work medium to the crank shaft not only during the down stroke, but while on the up stroke; each piston is situated between two systems. This is not true of a single acting piston arrangement within the Stirling engine. The upward stroke of the double-acting piston coincides for a large part with the expansion of the system preceding the piston and with the compression of the system downstream of the piston; conversely the downstroke coincides for a large part with the expansion of the downstream system and the compression with the upstream system. With a four cylinder double-acting type engine, there should be a phase shift of 90° in the motions of the pistons. Volume variations of the corresponding hot and cold spaces then likewise will differ 90° in phase. Of course, combinations can also be made with more than four systems and with different phase relationships. Within certain limits, this has little effect upon the efficiency of the engine, since the curve representing the efficiency of the hot gas process is a function of the phase difference between the hot and cold spaces and is fairly constant near maximum. The method of communication between the hot and cold spaces must be such that volume variations of the hot space must occur before volume variations of the cold space for the same thermodynamic unit. The order of piston movements determines the direction of rotation of the engine. Depending upon the power output of the engine desired, the multiple number of cylinders can be arranged in a variety of patterns including in-line, v-shape, star-shape and square. With the latter, a swash-plate mechanism is suitable as the output drive.

In spite of the obvious advantages of the double-acting piston arrangement of a Stirling engine, there arises a critical problem during stalling of the engine. Both sides of the same piston are utilized for purposes of serving two distinct and separate thermodynamic units. During cold start up or following an engine stall during operation, double-acting piston engines characteristically will have equal pressures in the upper and lower portion of the cylinder. However, the surface areas over which the equalized pressures act are different. This results from the fact that the piston rod is typically attached to one side of any given double-acting piston. The net areas exposed to the working gas will be unequal due to the subtraction of the area occupied by the piston rod. Under certain conditions, primarily during an engine stall at high mean system pressure, restarting of the engine can become impossible due to the unbalance of forces across the piston surfaces.

SUMMARY OF THE INVENTION

A primary object of this invention is to provide an improved Stirling-type engine employing double-acting pistons, the improvement providing for reduced engine starting torque.

Yet another object of this invention is to provide a Stirling-type engine of the regenerative external combustion type which employs a means of compensating for differential piston surface areas within a double-acting piston arrangement.

Features pursuant to the objects comprise the use of (*a*) a variable area valve having one surface exposed to engine pressure and another surface exposed to the low temperature chamber, the latter having a reduced surface area with reference to the first surface, and (*b*) the employment of means to isolate the variable area valve and thereby remove or prevent communication between said valve and the engine during normal operation of the engine.

SUMMARY OF THE DRAWINGS

FIG. 1 is a schematic illustration of a portion of the double-acting piston system of a Stirling type engine relating to the closed working fluid circuit, said embodiment being in accordance with the principles of the prior art; and FIG. 2 is a schematic illustration similar to FIG. 1, of a portion, but modified in accordance with the present invention.

DETAILED DESCRIPTION

Turning to FIG. 1, there is illustrated a portion of the closed working fluid system 7 of a Stirling-type engine having the pistons arranged in a double-acting manner. A plurality of cylinders, two of which are shown here as 10 and 11, have the volume therein each respectively subdivided by pistons or reciprocating heads 8 and 9 so that each cylinder will have a variable volume comprised of a high temperature (hot) space and a low temperature (cold) space. For example, with respect to cylinder 10, the hot space is identified as 13 and the low temperature space as 14; with respect to cylinder 11, the hot space is identified as 15 and the low temperature space as 16. Each hot space of one cylinder is connected by a suitable communicating means 26 to the low temperature space 16 of the next most adjacent cylinder. Such communicating means comprises a gas passage 27 in which is interposed a regenerator 28 and a cooling apparatus 29, each functioning in the typical manner of the Stirling-type engine, whereby gas is being displaced from the hot chamber 13 and conveyed through passage 27 allowing the heat content thereof to be absorbed by regenerator 28 and to be further cooled by mechanism 29 before entering the low temperature space 16. Such gases are again displaced during another phase of the Stirling cycle, from the low temperature space 16 back through the passage 27, absorbing heat units from the heat regenerator 28 and again reentering the hot chamber 13.

The control and operation of a double-acting hot gas type of engine is more typically described in the prior art and specific reference herein is made to U.S. Pat. No. 3,859,792 which demonstrates a control whereby the mean working pressure within said variable spaces is controlled to provide an increase or decrease of engine speed and torque.

Pistons 8 and 9 are mechanically linked together to a common driven mechanism so as to be out of phase with respect to each other in accordance with the desired variable volume changes in said cylinders. During compression of space 14, piston 8 is extracting work energy; piston 8 also extracts work energy during the upstroke for contraction of space 13. When both sides of the same piston are utilized for purposes of serving two separate thermodynamic systems, startup or a restart problem must be overcome. The inability to start from a stalled or cold engine is caused by the differential working surfaces of each piston. The top surface area 21 and 22 of piston 8 and 9 are each generally defined by the diameter of the piston and is uninterrupted; the other side or lower surfaces 23 and 24 of each of the pistons would be normally equal except for the presence of the areas occupied by the piston rods 19 and 20. Accordingly, the working surface area of surface 21 is opposed by the working surface area of surface 23 minus the area due to the piston rod. Another way of stating this is that the area ratio between surface 21 and surface 23 will always be less than 1. Since force is equal to pressure times the area over which it works, the force acting upon surface 21 will always be greater than the force acting upon surface 23 when the pressures are generally equal in the chambers 13 and 14. The same analysis applies to the other pistons in the system.

Turning now to FIG. 2, a compensating means 30 is interposed in the communicating means 26. The compensating means comprises a passage 31 placed in parallel with passage 27; passage 31 contains a variable area valve means 32, a one-way flow control device 33, and a control means 34 for isolating said parallel passage 31 from the communicating means. The variable area valve 32 or amplifying means comprises a central spool member 35 slidably received with a cylindrical opening 36; one end of the member 35 carries a piston head 37 having a diameter 38, the head reciprocating within enlarged chamber 39. The opposite end of member 35 has a reduced piston head 40, a diameter 41 predetermined to be smaller than diameter 38. Head 40 reciprocates within a reduced chamber 42; chamber 42 is in communication by way of passage 31 with the low temperature space 14 and the larger chamber 39 is in communication with the passage 27 by way of the other portion of passage 31.

The control means 34 comprises a shuttle valve 44 adapted to move in a reciprocating manner (see arrows) within a chamber 45 having walls interrupting the communicating passage 27. The valve member has a first opening 46 therethrough adapted to align with passage 27 when stationed coaxially therewith; the member has a second passage 47 adapted to align with passage 31 when the member is moved upwardly to coaxially align therewith.

The one-way control means 33 may be simply a ball check valve adapted to permit flow in the direction of the arrow shown in FIG. 2 (toward the low temperature chamber 14) but prevent flow in the opposite direction.

In operation, and assuming normal operating conditions with the engine not stalled, the control means 34 is positioned so that opening 46 is aligned with passage 27 thereby isolating the variable area valve means 32 from the normal communicating passage 27. When a stalled engine condition exists, which may be due to any of several effects, the control means is moved to a position where opening 47 is aligned with passage 31 thereby allowing fluid pressure within the working chambers to be communicated to the lefthand face or surface 37a of the head 37 of the variable area valve. The area of surface 37a is greater than the area of surface 40a and will cause the pressure of the fluid in the passage 31 communicating with the cold chamber 14 to be increased. The differential surface areas therebetween is predetermined so that the force acting on surface 23 will be generally equal to the force acting normally on surface 21 after the variable area means is placed in operation.

I claim:

1. A closed working fluid circuit for a regenerative type Stirling engine, the closed working fluid system having a plurality of chambers subdivided by double-acting pistons operating therein, the subdivided chambers being connected in a series whereby the hot chamber is in communication with the cold chamber of the next most adjacent cylinder, said intercommunication between adjacent cylinders containing a regenerator and a cooling mechanism, the improvement comprising:

a. means defining a fluid path in parallel with said intercommunication, b. fluid pressure amplifying means interposed in said path in parallel whereby the mean pressure in said intercommunication may be increased in magnitude when transmitted to the low temperature variable volume chamber, and c. control means for selectively placing said path in parallel fluid communication with said intercommunication and for selectively isolating said path in parallel therefrom.

2. The improvement as in claim 1, in which said parallel path has a one-way flow valve therein disposed between said low temperature variable volume space and said fluid pressure amplifying means.

3. The improvement as in claim 1, in which said fluid amplifying means comprises a spool valve having one pressure head exposed to the mean pressure in said intercommunication and a smaller pressure head exposed directly to the fluid pressure in said low temperature space whereby the pressure in said low temperature space may be increased to a level such that the resultant forces acting on each side of said pistons are equal.

4. The improvement as in claim 1, in which said control means comprises a shuttle valve having two passages, one passage being adapted to be aligned with said communicating means for permitting fluid flow through said path in parallel and the other passage being adapted to be aligned with said intercommunication for permitting flow only through said intercommunication.

* * * * *